US008051591B2

(12) United States Patent
Troiano et al.

(10) Patent No.: US 8,051,591 B2
(45) Date of Patent: Nov. 8, 2011

(54) GUIDE AND ANCHOR SYSTEM FOR A BILLBOARD TENSIONING SYSTEM

(75) Inventors: Thomas P. Troiano, Sycamore, OH (US); Shawn P. Fitch, Tiffin, OH (US)

(73) Assignee: Tiffin Metal Products Co., Tiffin, OH (US)

( * ) Notice: Subject to any disclaimer, the term of this patent is extended or adjusted under 35 U.S.C. 154(b) by 269 days.

(21) Appl. No.: 12/587,520

(22) Filed: Oct. 7, 2009

(65) Prior Publication Data

US 2010/0083546 A1 Apr. 8, 2010

Related U.S. Application Data

(60) Provisional application No. 61/195,584, filed on Oct. 8, 2008.

(51) Int. Cl.
*G09F 15/00* (2006.01)

(52) U.S. Cl. ..... 40/624; 40/603

(58) Field of Classification Search ..... 40/624, 40/603, 741, 601; 248/49; 242/615, 615.3; 160/378

See application file for complete search history.

(56) References Cited

U.S. PATENT DOCUMENTS 1,548,249 A * 8/1925 Binns ..... 40/741
5,066,149 A * 11/1991 Wheeler et al. ..... 385/135
2007/0034750 A1 * 2/2007 Pierce et al. ..... 248/49

FOREIGN PATENT DOCUMENTS

GB 2090131 A 7/1982

* cited by examiner

*Primary Examiner* — Joanne Silbermann
*Assistant Examiner* — Christopher e Veraa
(74) *Attorney, Agent, or Firm* — Marshall & Melhorn LLC

(57) ABSTRACT

The present invention relates to a guide and tensioning system for a billboard, comprising a facing area surrounded by trim pieces. The trim pieces each comprise a back plate, a side plate and a front plate. Guide groups may be located at various locations along the outside edge of the back plate. The guide groups may comprise an arced guide located between two tab guides or a keeper tab may be centered over the arced guide. The guide group may also comprise a clip that selectively secures to the arced guide. The clip has a complimentary shape to the arced guide and to a gap in the back plate. Hook-like structures on the clip selectively engage with the end edge portions of the arced guide. When engaged with the arced guide, the clip preferably prevents a cable member from falling behind the back plate.

23 Claims, 7 Drawing Sheets

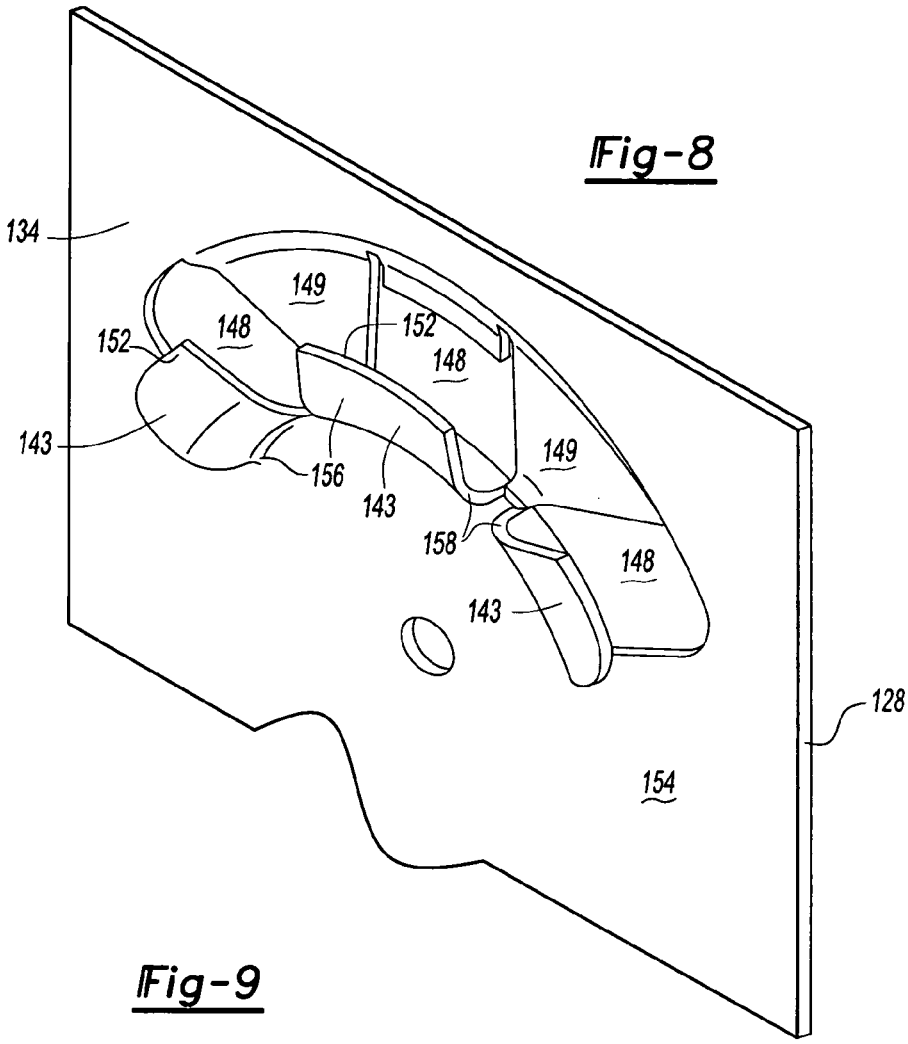
Fig-8
Fig-9
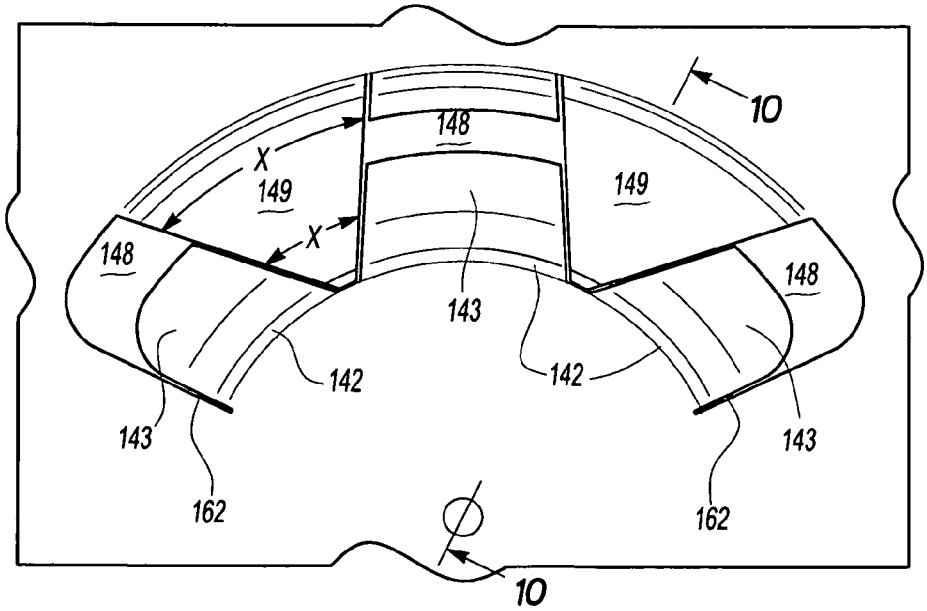

GUIDE AND ANCHOR SYSTEM FOR A BILLBOARD TENSIONING SYSTEM

CROSS-REFERENCE TO RELATED APPLICATIONS

This application claims the benefit of U.S. Provisional Application No. 61/195,584 filed Oct. 8, 2008, the disclosure of which is incorporated herein by reference.

FIELD OF THE INVENTION

The present invention relates to a guide and anchor system that may be used with a wide variety of systems used to tension the sheet of material comprising the sign displayed on a billboard.

BACKGROUND OF THE INVENTION

Billboards are well known devices used to display large format messages. The messages may be located on one or more sheets of material that are located on or adjacent to the panel or panels that extend across the frame of the billboard.

Typically, the sheet or sheets of material are pulled across the panel or panels so that the sheet(s) are taut. This tensioning step ensures that the sheet(s) are properly positioned on the frame, properly secured on the frame and it creates a sign that is aesthetically pleasing.

There are a variety of prior art tensioning systems that cooperate with the billboard frame to provide tension to the sheet(s) to accomplish the foregoing objectives. Unfortunately, the billboard frame often must be highly modified to accommodate the various tensioning systems. The modifications require a large amount of additional hardware that must be added to the frame. This extra hardware is both expensive in terms of the parts themselves as well as the labor required to install the many parts of the system. The large number of parts is also problematic because the parts may be installed in the wrong location on the billboard and/or the parts may be lost during delivery or installation. Additionally, the added parts are often prone to rusting, which may diminish the aesthetic value of the entire system, result in premature failure and result in increased repair or replacement efforts.

In view of the foregoing disadvantages of the prior art it would be advantageous for a guide and anchor system for a billboard tensioning system to be cost effective both in terms of parts and labor. It would also be advantageous for the system to have a minimum number of parts to minimize potential part loss and installation problems. Preferably, the system would also be readily compatible with any of the available, or future, tensioning systems. It would also be advantageous for the system to be effective but simple to use. Additionally, it would be advantageous for the system to be robust and weather resistant.

SUMMARY OF THE INVENTION

The present invention is directed toward a guide and tensioning system for a billboard. The billboard is adapted to receive poster sheets or artwork on a facing area. The facing area is surrounded by trim pieces. The trim pieces preferably each comprise a back plate, a side plate and a front plate creating the appearance of a C-shaped channel. A first guide group is preferably located at an upper portion of the back plate of the first side trim piece and a second guide group is preferably located at a lower portion of the back plate of the first side trim piece.

The guide groups may comprise an arced guide located between two tab guides. The guide group may alternatively comprise a keeper tab centered over the arced guide and fastened to the back plate. The guide group may also comprise a clip that selectively secures to the arced guide. The clip has a complimentary shape to the arced guide and to a gap in the back plate. Hook-like structures on the clip selectively engage with the end edge portions of the arced guide. When engaged with the arced guide, the clip substantially fills and/or closes the gap of the arced guide in the plate. The clip thus advantageously functions to prevent a cable member from falling behind the back plate.

BRIEF DESCRIPTION OF THE DRAWINGS

The above, as well as other advantages of the present invention, will become readily apparent to those skilled in the art from the following detailed description when considered in the light of the accompanying drawings in which:

FIG. 8 depicts a second embodiment of the present invention;

FIG. 9 is a front view embodiment in FIG. 8;

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts herein. Hence, specific dimensions, directions or other physical characteristics relating to the embodiments disclosed are not to be considered as limiting, unless expressly stated otherwise.

Figure 1:
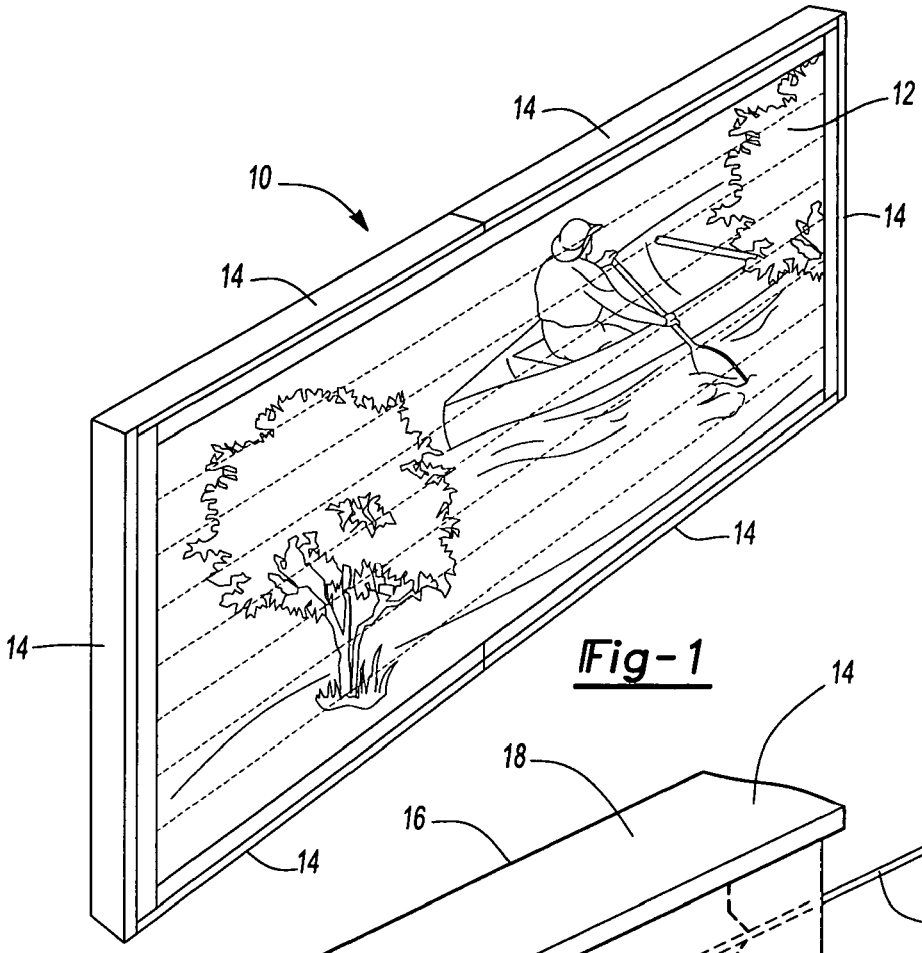
FIG. 1 is a perspective view of one embodiment of a billboard.
Figure 2:
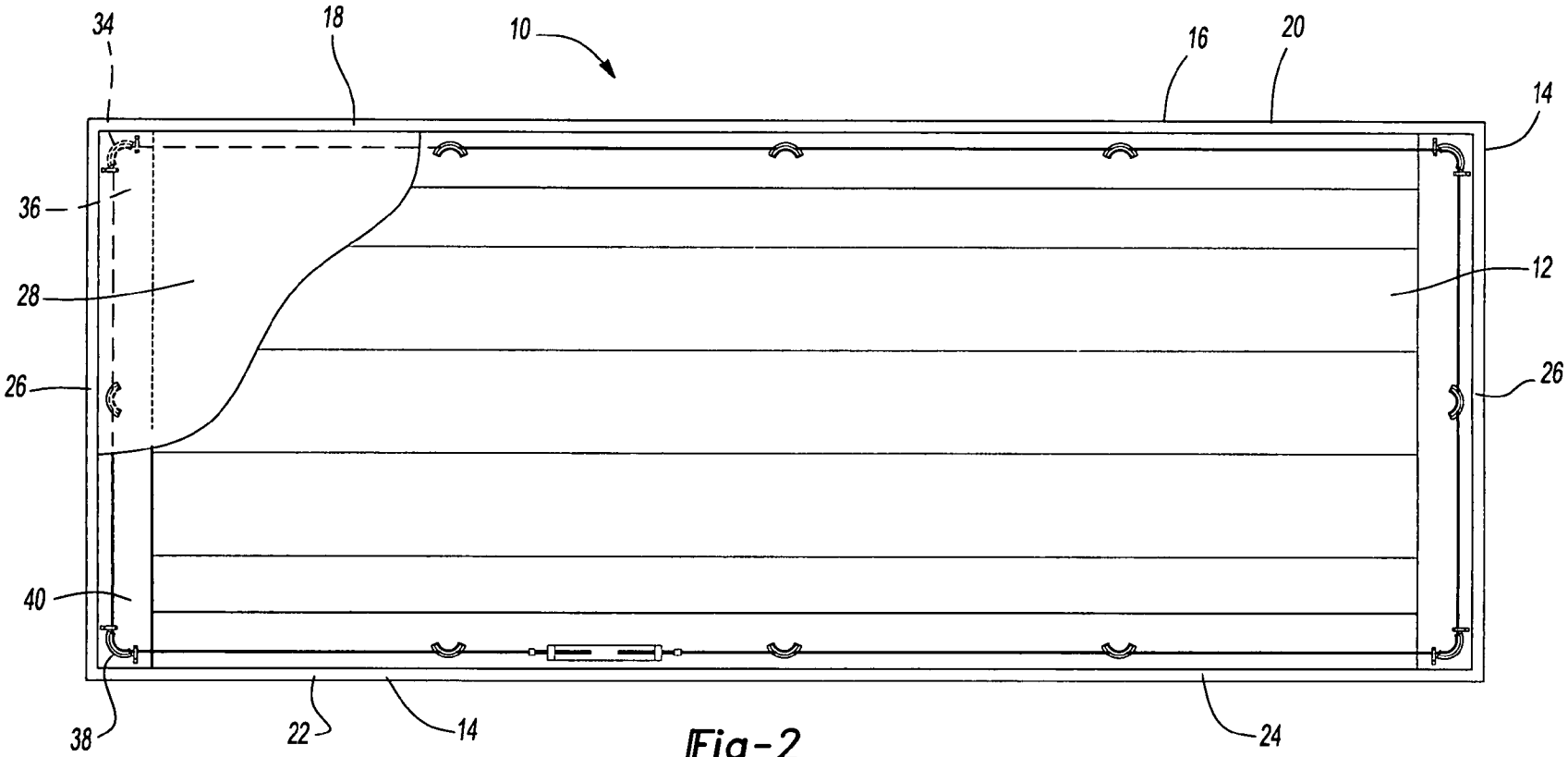
FIG. 2 is a detailed view of a billboard guide and anchor components.

Turning now to FIGS. 1 and 2, one embodiment of a billboard 10 is depicted. The billboard 10 comprises a facing area 12 adapted to receive poster sheets or artwork. The facing area 12 may be surrounded by trim pieces 14. A framework about the billboard 10 supports the facing area 12 and/or the trim pieces 14. The framework is not critical to the present invention nor is the means to support the billboard 10, such as posts to be mounted in the ground. Thus, neither the framework nor the means to support the billboard 10 are depicted in the figures.

The trim pieces 14 extend substantially about the perimeter 16 of the billboard 10. In the depicted embodiment, six trim pieces 14 are utilized to extend about the perimeter 16. While six trim pieces 14 comprise the preferred embodiment, perimeters comprised of greater or fewer trim pieces are within the scope of the present invention.

Preferably, the perimeter 16 comprises a first upper trim piece 18, a second upper trim piece 20, a first lower trim piece 22 and a second lower trim piece 24. The two upper trim pieces 18, 20 may be secured together by one or more mechanical fasteners, such as nuts and bolts. Similarly, the two lower trim pieces 22, 24 may be secured together by one or more mechanical fasteners. Alternatively, it can be appreciated that the upper pieces 18, 20 and the lower pieces 22, 24 may be each made as one piece, respectively. The trim pieces 18-24 are preferably constructed primarily, if not entirely, of a highly wear and weather resistant material, such as coated or painted metal.

The perimeter 16 also comprises at least two side pieces 26. The side pieces 26 are preferably of a unitary construction; however, the side pieces 26 may also be constructed of multiple pieces that are secured together by means similar to those disclosed above for the upper and lower pieces 18-24.

The side pieces 26 may be secured to the upper and lower pieces 18-24 and/or they may be secured to the billboard frame and/or the facing area 12. The various pieces 18-26 are secured to one another, the frame and/or the facing area 12 with mechanical fasteners, such as but not limited to, bolts and nuts, and/or screws.

Figure 3:
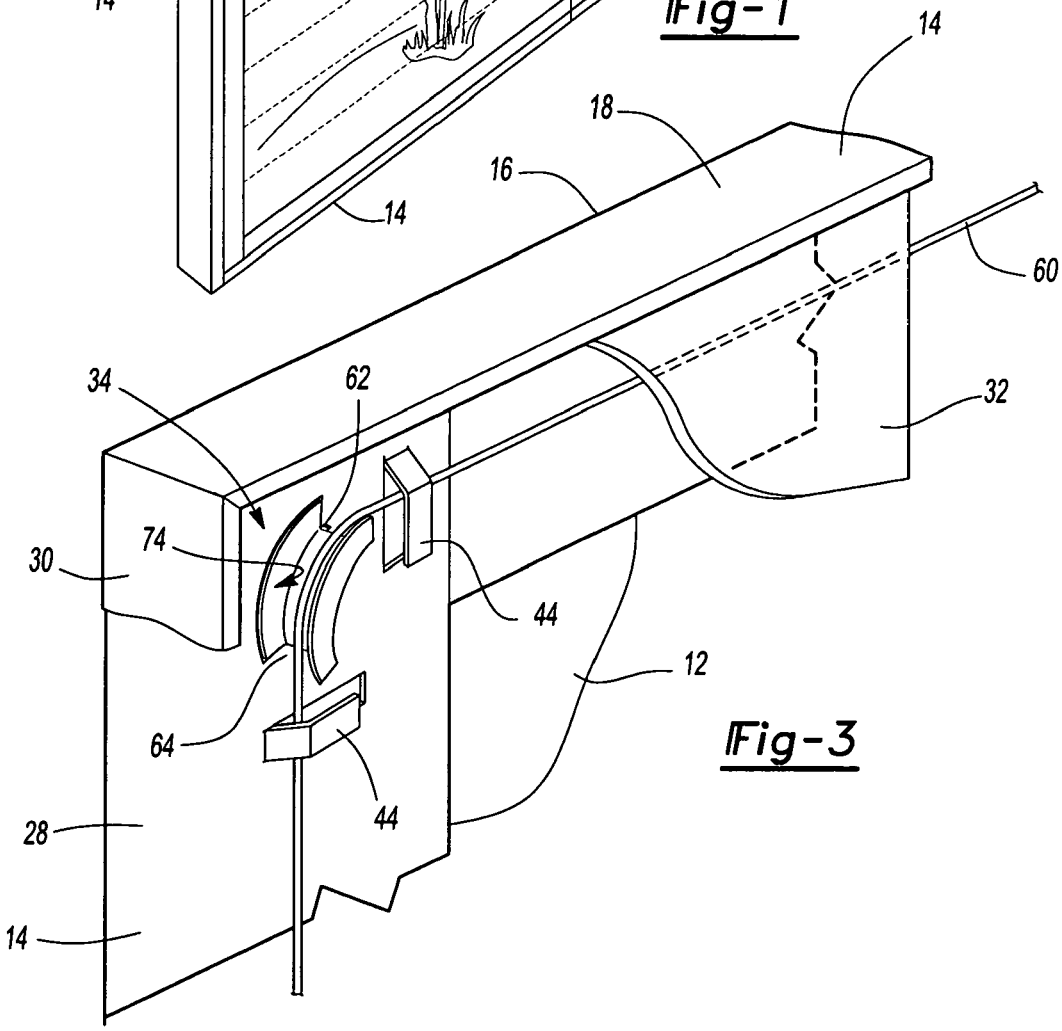
FIG. 3 is a first embodiment of a portion of a billboard guide and anchor tensioning system of the present invention.

Turning now to FIG. 3, one embodiment of a section of the perimeter 16 depicted in FIGS. 1 and 2 is shown. In this figure, a preferred shape of the trim pieces 14 can be seen. The trim pieces 14 preferably each comprise a back plate 28, a side plate 30 and a front plate 32. The back plate 28 abuts the facing area 12 and is parallel with it; the side plate 30 is oriented perpendicular to the facing area 12; and the front plate 32 is oriented substantially parallel to the back plate 28. Preferably, the front plate 32 overlaps at least a portion of the back plate 28 to form a C-shaped channel.

While one embodiment of a C-shaped channel has been depicted in FIG. 3, it can be appreciated that other embodiments are within the scope of the present invention. For example, other channel shapes, such as those having greater or fewer surfaces are permissible. Additionally, channel shapes that are curvilinear or partially curvilinear are permissible. It is also within the scope of the present invention to eliminate the channel entirely, as discussed more below.

As depicted in FIG. 2, a first guide group 34 is preferably located at an upper portion 36 of the back plate 28 of the first side trim piece 26 and a second guide group 38 is preferably located at a lower portion 40 of the back plate 28 of the first side trim piece 26. Additional guide groups may be located at other corners of the billboard as shown. The guide groups 34, 38 are preferably substantially identical. Thus, the following is limited to a discussion of the first guide group 34.

Since the guide groups 34, 38 can reside on just the back plate 28, it can be appreciated that the side plate 30 and the front plate 32 are not required. Thus, it is within the scope of the invention for the structure deemed the back plate 28 to entirely comprise the trim piece 14. It will be appreciated based on the following description that other structures associate with the invention may also reside entirely on the back plate 28 without any need for further interaction with the plates 30 or 32.

FIGS. 4, 5, 6 and 7 depict an embodiment of the first guide group 34. The first guide group 34 may comprise an arced guide 42 located between two tab guides 44. A section 46 of the back plate 28 preferably separates the arced guide 42 from the two tab guides 44, such that the gaps 48, 50 created by the guides 42, 44 in the plate 28 are not connected to one another.

It is also within the scope of the present invention to eliminate the tab guides 44 from the guide groups 34, 38. The discussion below includes the tab guides 44 as part of the guide groups 34, 38, but they may be removed and the embodiment of the invention without the tab guides 44 can be readily appreciated.

In the depicted preferred embodiment, the guides 42, 44 are unitary with the back plate 28. The unitary guides 42, 44 may be formed from the plate 28 by stamping or the like. Guides 42, 44 that are stamped from the trim pieces 14 have substantially the same thickness as the trim pieces 14 themselves. Thus, the guides 42, 44 are of a robust construction. Additionally, by being stamped there is no need for mechanical fasteners to secure the guides 42, 44 to the trim pieces 14. Preferably, both guides 42, 44 extend outwardly from the same side of the back plate 28.

The guides 42, 44 are simultaneously subjected to the same finishing process as the trim pieces 14 that make the trim pieces 14 both weather and rust resistant. Such processes may include, but are not limited to, priming, painting and/or sealing.

The arced guide 42 is substantially comprised of two portions. The first portion 52 is angled with respect to the front surface 54 of the back plate 28. The second portion 56 is angled with respect to the first portion 52. A radiused transition 58 may be provided between the two arced guide portions 52, 56.

When the arced guide 42 is stamped from the back plate 28, a gap 48 in the back plate 28 having a width substantially equal to the height of the first portion 52 and the width of the second portion 56 is provided.

Preferably, the arced guide 42 spans a degree of arc of approximately 180 degrees. A degree of arc of approximately 180 degrees minimizes the likelihood that a cable member 60 does not rub against the end edge portions 62 of the arced guide 42. Rubbing against these end edge portions 62 can result in both wear to the cable member 60 as well as to the arced guide 42.

Figure 4:
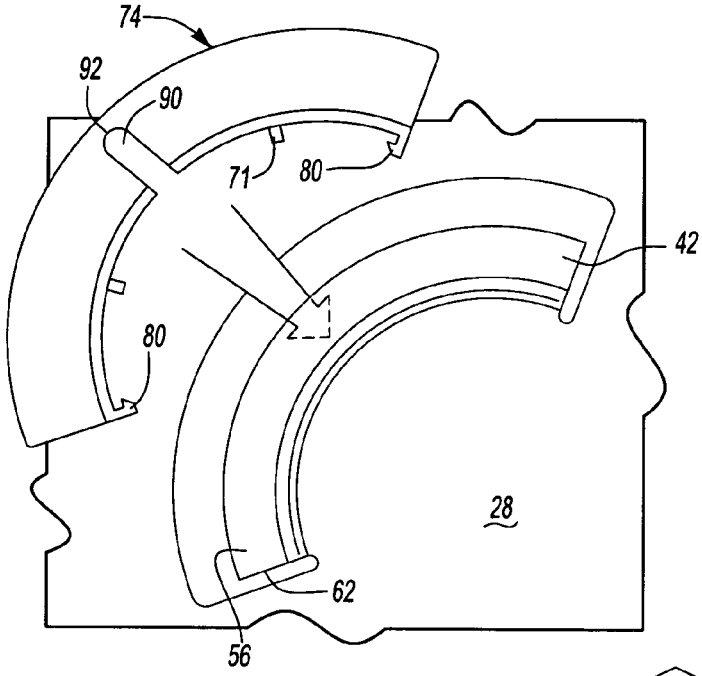
FIG. 4 depicts an additional structure exploded from the structure of FIG. 3.
Figure 5:
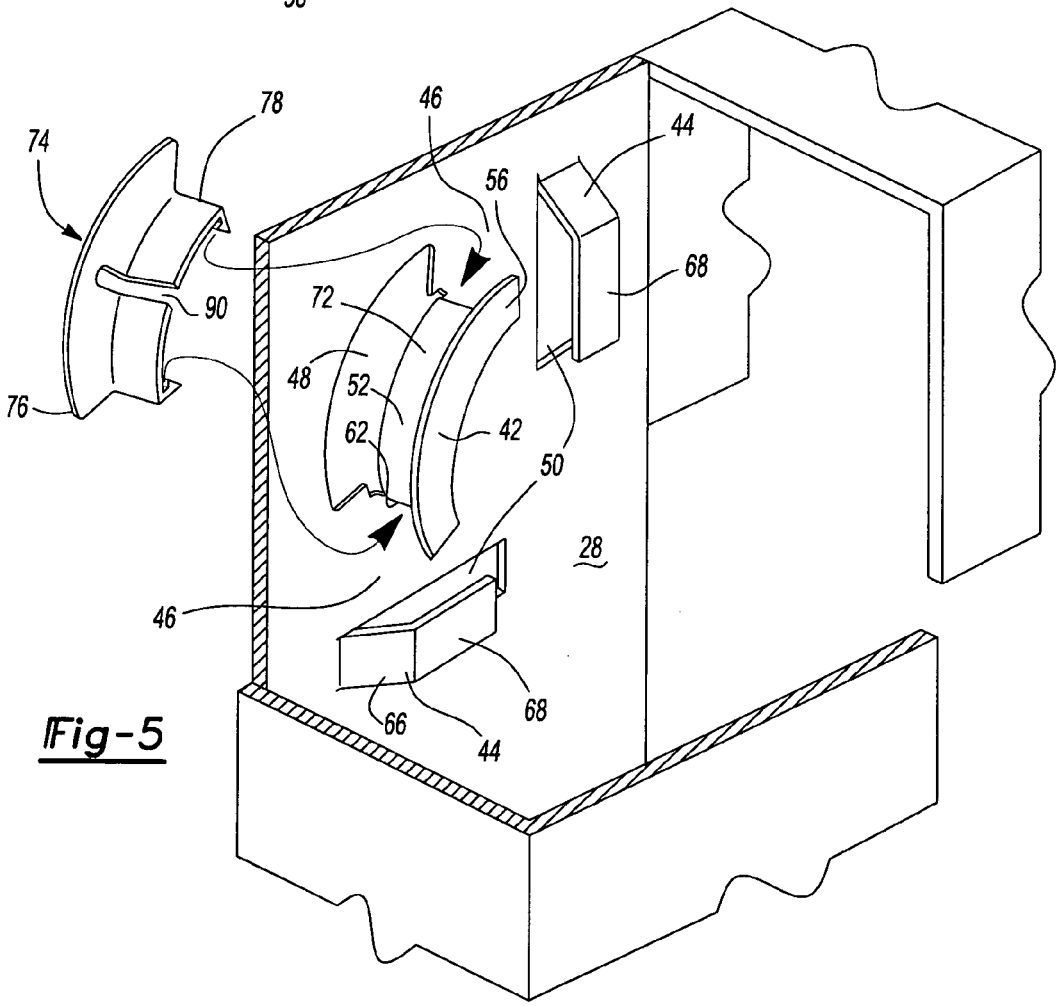
FIG. 5 depicts the structure of FIG. 4 installed on the structure of FIGS. 3 and 4.
Figure 6:
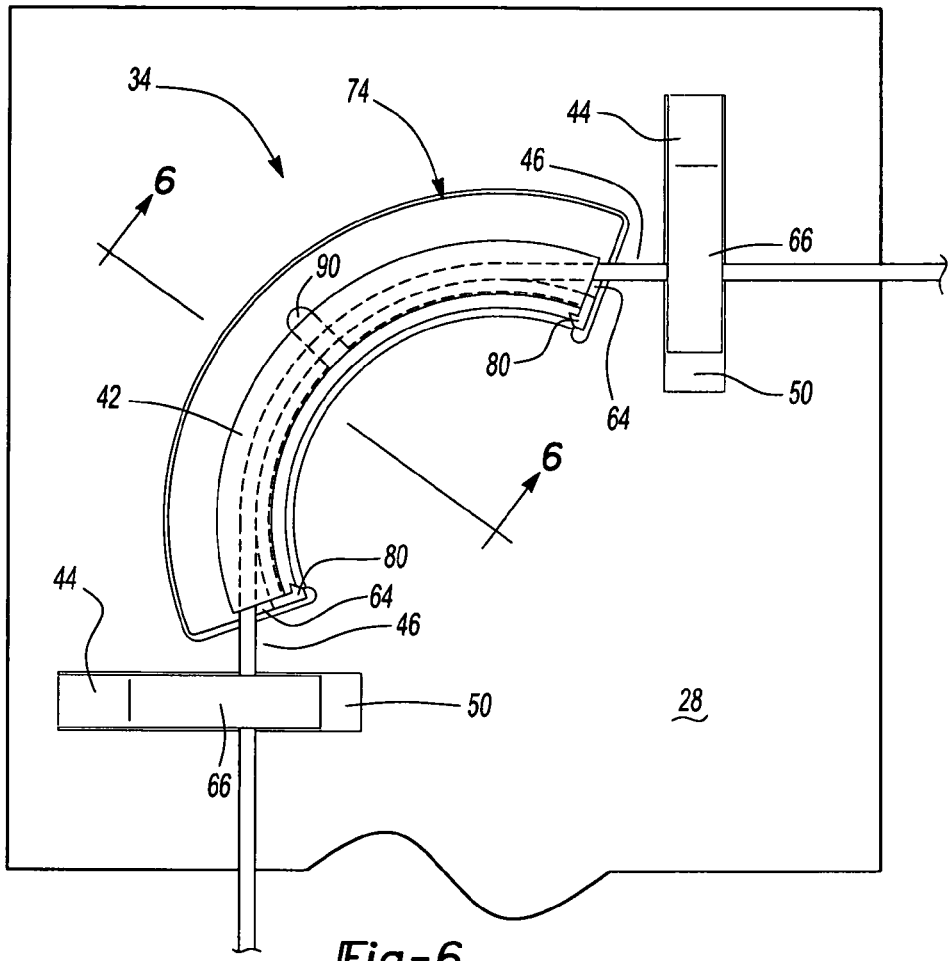
FIG. 6 is front view of the detail of FIG. 3.
Figure 7:
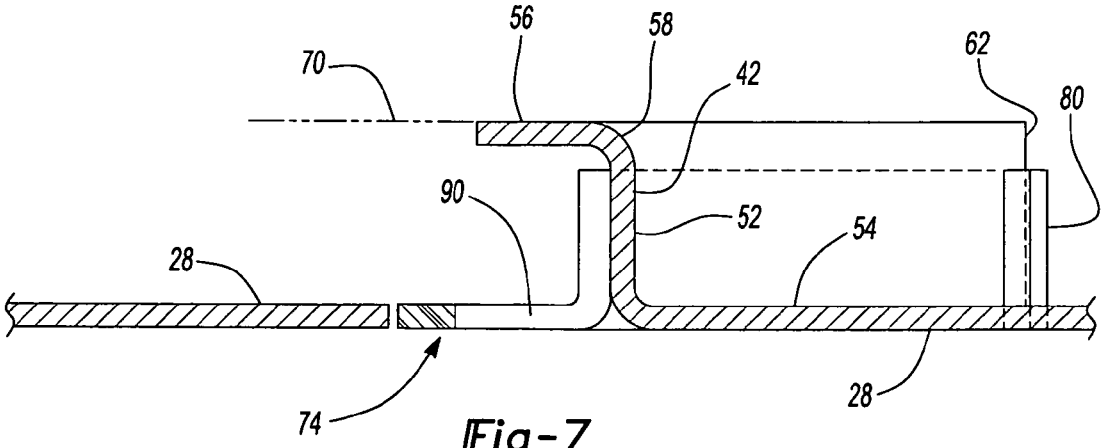
FIG. 7 is a cross-sectional view along line 6-6 of the detail of FIG. 6.
Figure 10:
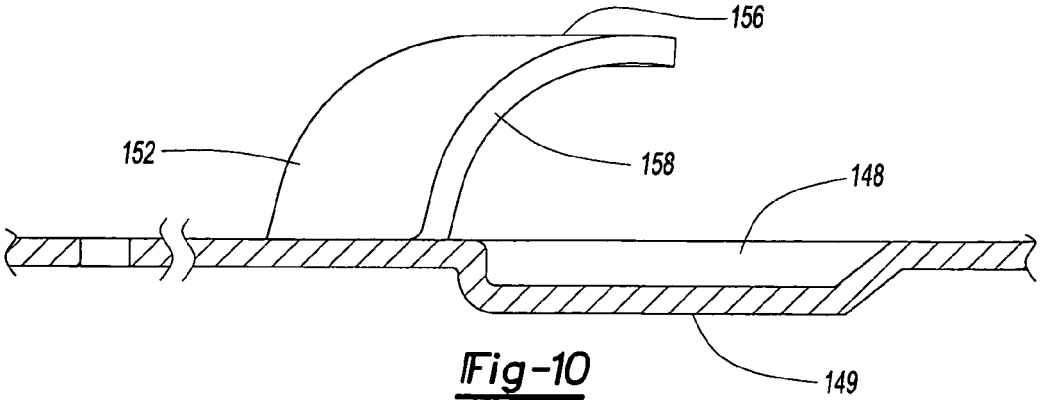
FIG. 10 is a cross-sectional view along line 10-10 of the detail of FIG. 9.
Figure 11:
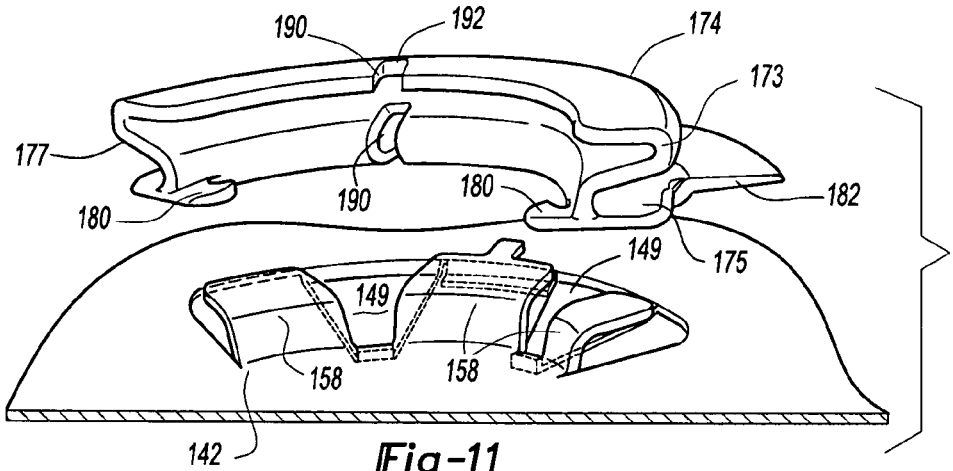
FIG. 11 depicts an additional structure exploded from the structure of FIG. 12.
Figure 12:
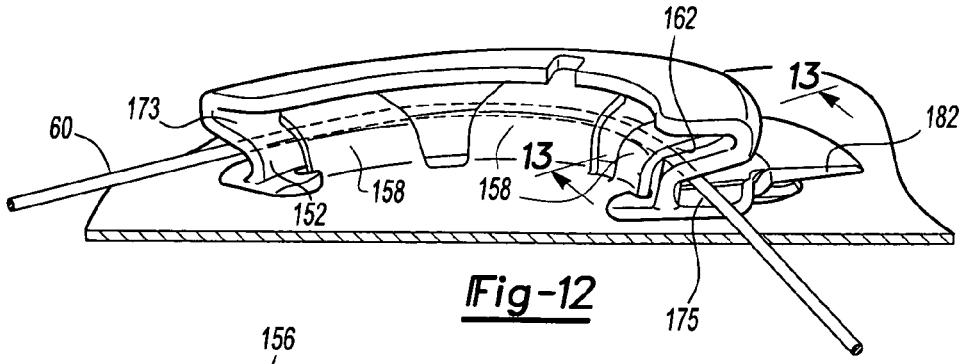
FIG. 12 depicts the structure of FIG. 11 installed on the structure of FIG. 8.
Figure 13:
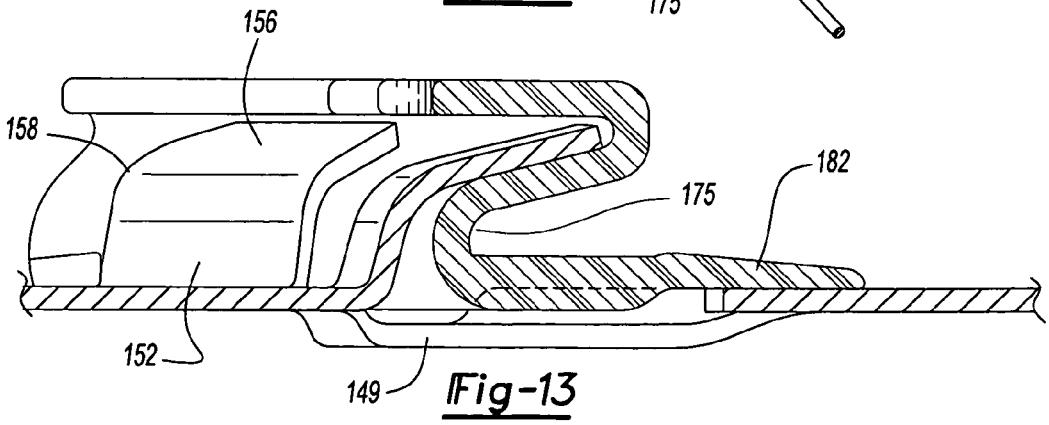
FIG. 13 is a cross-sectional view along line 13-13 of the detail of FIG. 12.

As can be appreciated from FIGS. 3 and 4, a gap 64 is created between the cable member 60 and the end edge portions 62 because of the degree of arc of the guide 42 and the direction of the cable member 60 as it extends from guide to guide.

Adjacent, but spaced from, the end edge portions 62 of the arced guide 42 are the tab guides 44, if present. The tab guides 44 are preferably identical to one another, thus only one tab guide 44 will be described herein.

As with the arced guide 42, the tab guide 44 leaves a gap 50 that is substantially equal to the length of the tab 44 when it is stamped from the back plate 28. The gap 50 and the tab guide 44 are oriented substantially perpendicular to the end edge portion 62 of the arced guide 42.

The tab guide 44 preferably comprises two portions. A first portion 66 of the tab guide 44 is unitary with the back plate 28 and a second portion 68 is unitary with the first portion 66. The first portion 66 angles away from the back plate 28 so as to locate the second portion 68 in a parallel but spaced apart relationship from the back plate 28. The second portion 68 of the tab guide 44 and the second portion 56 of the arced guide 42 may be in the same plane 70 with one another.

This orientation ensures that the cable member 60, which extends through the tab guide 44 and about the arced guide 42, is maintained in a relatively narrow cable member channel 72. The cable member channel 72 is located between the back plate 28 and the two portions 66, 68 of the tab guide 44 and about the arced guide 42. By virtue of their above described locations and designs, the guides 42, 44 maintain the cable member 60 within this channel 72 to prevent upward and downward migration of the cable member 60.

Preferably, one or more arced guides 42 are located along the length of each side trim piece 26 and each upper and lower trim piece 18-24 as shown in FIG. 2. In the depicted embodiment, tab guides 44 are not included with the arced guides 42; however, it is within the scope of the present invention to do so. It is also within the scope of the present invention to utilize tab guides 44 in lieu of the arced guides 42. The arced guides 42, however, are preferred as they ensure that a cable member 60 located adjacent their curvilinear surfaces is not trapped and/or so that the cable member 60 or the guide 42 is not excessively worn.

A guide group 34 may also comprise clip 74 that selectively secures to the arced guide 42. The clip 74 may be formed of any resilient and weather-proof material, such as nylon. While nylon is disclosed, the present invention is not limited to just this material. Instead, the clip 74 may be constructed of metal, plastic, rubber-based materials and/or fiberglass either alone or in combination with nylon.

The clip 74 preferably has a first portion 76 and a second portion 78 that is substantially perpendicular to the first portion 76. The first and second portions 76, 78 are preferably one-piece with one another, but they may be two pieces that have been joined together. Preferably, the clip 74 has a complimentary shape to the arced guide 42. The clip may comprise a plurality of raised ribs 71 on the innermost curved surface of the second portion 78. The first portion 76 is substantially straight sided with curvilinear portions at the top of the arc and at the outermost ends.

Two hook-like structures 80 are preferably integrally formed with the first portion 76. The hook-like structures 80 selectively engage with the end edge portions 62 of the arced guide 42. Preferably, the clip 74 is constructed of a material, such as nylon, that has a degree of flexibility so that the hook-like structures 80 can be flexibly engaged around the end edge portions 62.

The clip 74 contains an arched cut-out portion 90 in the center of the arc. The arch 90 is perpendicular to the first and second portions 76, 78. A bridge 92 in the arch connects two halves of the first and second portions 76, 78 so that the two portions 76, 78 form a continuous arc. The arched cut-out portion 90 adds flexibility to the clip for engagement with the back plate 28.

When engaged with the arced guide 42, the clip 74 substantially fills and/or closes the gap 48 of the arced guide 42 in the plate 28. The clip 74 thus advantageously functions to prevent the cable member 60 from falling behind the back plate 28.

FIGS. 8, 9, 10, 11, 12 and 13 depict a second embodiment of the first guide group 34. Components, which are unchanged from the previous embodiment of the present invention, are labeled with the same reference characters. Components, which function in the same way as in the first embodiment of the present invention depicted in FIGS. 2-7 are designated by the same reference numerals to which 100 has been added, sometimes without being described in detail since similarities between the corresponding parts in the two embodiments will be readily perceived by the reader.

In the depicted embodiment of the guide group 134, the arced guide 142 is divided into tabs 143. The tabbed arced guide 142 may be formed from the plate 128 by stamping or the like. Guide 142 that is stamped from the trim pieces 14 has substantially the same thickness as the trim pieces 14 themselves. Thus, the guide 142 is of a robust construction. Additionally, by being stamped there is no need for mechanical fasteners, welding or adhesive to secure the guide 142 to the trim pieces 14. Preferably, the guide 142 extends outwardly from the front surface 154 of the back plate 128.

The guide 142 is simultaneously subjected to the same finishing process as the trim pieces 14 that make the trim pieces 14 both weather and rust resistant. Such processes may include, but are not limited to, priming, painting and/or sealing.

In the depicted embodiment, the arced guide 142 comprises three tabs 143. While the arced guide 142 comprises three tabs 143 in the preferred embodiment, an arced guide comprising a greater or fewer number of tabs is within the scope of the present invention.

The tabs 143 of the arced guide 142 are each substantially comprised of two unitary portions. The first tab portion 152 is angled with respect to a front surface 154 of the back plate 128. The second tab portion 156 is angled with respect to the first tab portion 152. The first tab portion 152 and the second tab portion 156 may be substantially perpendicular with respect to each other. A radiused transition 158 may be provided between the two arced guide tab portions 152, 156. The angle X created between the second tab portions 156 increases as the distance from said first tab portions 152 increases.

A plurality of tab-shaped gaps 148 are formed in the back plate 128 when the arced guide 142 is formed from the back plate 128. The gaps 148 in the back plate 128 have a width substantially equal to the height of the first tab portion 152 and the width of the second tab portion 156. Intermittently spaced between the gaps 148 are a plurality of triangular shaped indentations 149. The indentations 149 are off-set from the front surface 154 of the back plate 128.

Preferably, the tabs 143 of the arced guide 142 span a degree of arc of approximately 180 degrees. A degree of arc of approximately 180 degrees minimizes the likelihood that a cable member 60 will rub against the end edge portions 162 of the outermost tabs of the arced guide 142. Rubbing against these end edge portions 162 can result in both wear to the cable member 160 as well as to the outermost tabs of the arced guide 142.

The guide group 134 may also comprise clip 174 that selectively secures to the arced guide 142. Preferably, the clip 174 has a complimentary shape to the tabbed arced guide 142. The clip 174 may be formed of any resilient and weather-proof material, such as nylon. While nylon is disclosed, the present invention is not limited to just this material. Instead, the clip 174 may be constructed of metal, plastic, rubber-based materials and/or fiberglass either alone or in combination with nylon.

The clip 174 is substantially S-shaped and comprises a dual channel sharing a singled walled surface 177. The first channel portion 173 of the S-shape and the second channel portion 175 of the S-shape are preferably one-piece with one another, but they may be two pieces that have been joined together. The dual channels are open opposite to one another, the first channel portion 173 faces down and the second channel portion 175 faces up. The first channel portion 173 engages the tabs 143 of the arced guide 142 so that the clip 174 is properly fit within the guide 142. The second channel portion 175 contacts a cable member 60 and ensures that the cable member 60 remains properly seated within its channel 72.

Two hook-like structures 180 are preferably integrally formed with the second channel portion 175. The hook-like structures 180 selectively engage with the end edge portions 162 of the outermost tabs 143 of the arced guide 142. Preferably, the clip 174 is constructed of a material, such as nylon, that has a degree of flexibility so that the hook-like structures 180 can be flexibly engaged around the end edge portions 162. Additionally on the outermost edges of the second channel 175 of said clip are cut out portions 182.

The clip 174 contains an arched cut-out portion 190 in the center of the arc. The arch 190 is perpendicular to the channels 173 and 175. A bridge 192 in the arch connects two halves of the first channel 173 so that the channel 173 forms a continuous arc. The arch 190 adds flexibility to the clip for engagement with the back plate 128.

When engaged with the tabs 143 of the arced guide 142, the clip 174 substantially fills and/or closes the gaps 148 of the tabbed arced guide 142 in the plate 128. The clip 174 thus advantageously functions to prevent the cable member 60 from falling behind the back plate 128.

Figure 14:
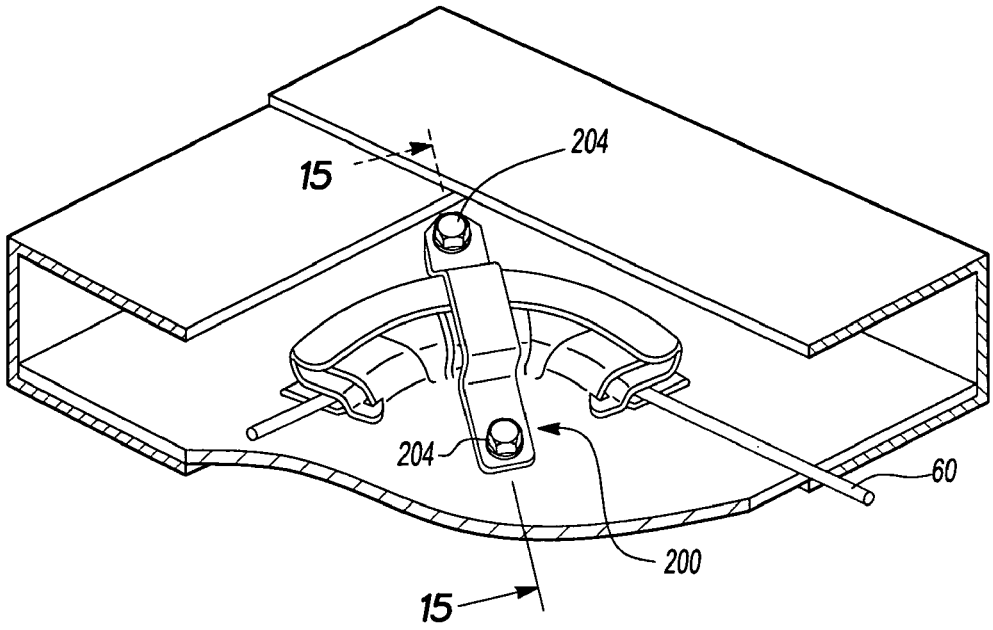
FIG. 14 depicts a third embodiment of the present invention.
Figure 15:
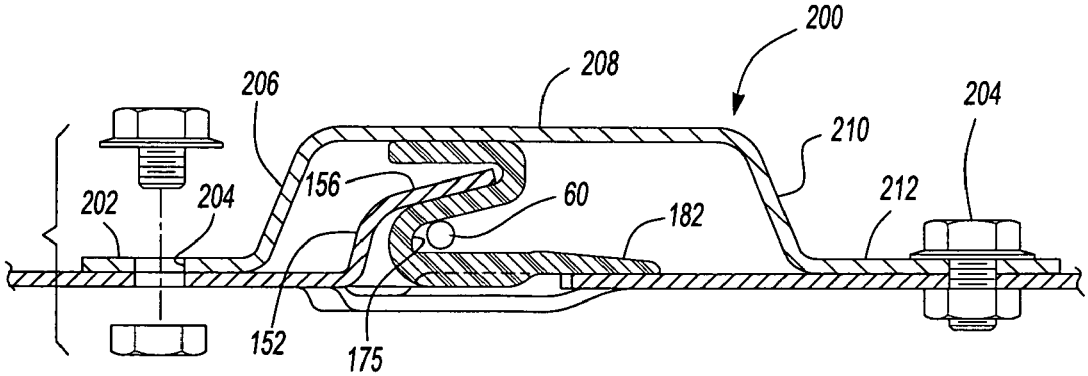
FIG. 15 is a cross-sectional view along line 15-15 of the detail of FIG. 14.

FIGS. 14 and 15 depict another embodiment of the guide group 134. In the depicted embodiment of the guide group 134 a keeper tab 200 is centered over the arced guide 142. The keeper tab 200 comprises a first land portion 202 with an aperture 204, a first ramp portion 206, a second land portion 208 located on a different vertical plane than the first land portion 202, a second ramp portion 210, and a third land portion 212, located within the same vertical plane as the first land portion 202. The third land portion also comprises an aperture 204. The apertures 204 in the keeper tab 200 are used to fasten the keeper tab 200 to the front surface 154 of the back plate 128. The keeper tab 200 may be secured to the front surface 154 of the back plate 128 with mechanical fasteners, such as but not limited to, bolts and nuts, and/or screws.

Based on the above, a system that guides a cable member 60 attached to a billboard sheet is disclosed. The same system not only guides the cable member 60, but it also functions to anchor the cable member 60 and its associated sheet to the billboard trim pieces 14 and the billboard frame. Further, since most tensioning systems utilize a cable member 60 extending about the sheet, the cable member 60 may be located about the guides 42, 44 for subsequent tensioning, regardless of the tensioning system, used without additional modification or hardware.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A guide assembly, comprising:

a back plate with a front surface and a rear surface;

an arced guide formed from said back plate, said arced guide comprising a plurality of tabs, each of said tabs comprised of two portions, a first tab portion angled with respect to said front surface of said back plate, and a second tab portion angled with respect to said first tab portion, said arced guide spans a degree of arc of approximately 180 degrees;

a plurality of tab-shaped gaps formed in said back plate, said gaps having a width substantially equal to the height of said first tab portion and the width of said second tab portion;

a plurality of triangular shaped indentations between said gaps in said back plate;

an S-shaped clip that selectively contacts said tabs of said arced guide, said clip has a complimentary shape to said tabs, said S-shape comprising a dual channel sharing a single walled surface, and comprising two hook-like structures integrally formed with a bottom portion of said clip, said hook-like structures selectively engage with end edge portions of outermost tabs of said arced guide, said bottom portion of said clip partially contacts said front surface of said back plate.

2. The guide assembly as defined in claim 1, wherein said second tab portion is oriented substantially parallel to said front surface of said back plate.

3. The guide assembly as defined in claim 1, wherein a radiused transition is provided between said first tab portion and said second tab portion of said arced guide.

4. The guide assembly as defined in claim 1, wherein an angle between said second tab portions of each of said plurality of tabs increases as the distance from said first tab portion increases.

5. The guide assembly as defined in claim 1, wherein said S-shape of said clip is in a cross-sectional view.

6. The guide assembly as defined in claim 1, wherein said clip contains an arched cut-out portion, said cut-out portion is perpendicular to said dual channels of said clip.

7. The guide assembly as defined in claim 1, wherein a first channel of said dual channels of said clip engages said plurality of tabs and a second channel of said dual channels of said clip accommodates a guide wire.

8. The dual channels as defined in claim 1, wherein said dual channels are opposed to one another, said first channel faces down and said second channel faces up.

9. The guide assembly as defined in claim 1, wherein the outermost corners of said second channel of said clip are cut out.

10. The guide assembly as defined in claim 1, wherein said triangular shaped indentations are off-set from said front surface of said back plate.

11. A guide assembly, comprising:

a back plate with a front surface and a rear surface;

a unitary arced guide formed from said back plate, said arced guide comprised of two portions, a first portion angled with respect to said front surface of said back plate, and a second portion oriented substantially parallel to said front surface of said back plate, said arced guide spans a degree of arc of approximately 180 degrees;

a gap with a width substantially equal to the height of said guide first portion and the width of said guide second portion;

a clip with a first portion and a second portion that is substantially perpendicular to said first portion, said clip comprising two hook-like structures integrally formed with said first portion of said clip that contacts said front surface of said back plate, said hook-like structures selectively engage with end edge portions of said arced guide.

12. The guide assembly as defined in claim 11, wherein a radiused transition is provided between said two tab portions of said arced guide.

13. The guide assembly as defined in claim 11, wherein said clip contains an arched cut-out portion, said cut-out portion is perpendicular to said clip portions.

14. The guide assembly as defined in claim 11, wherein said clip comprises a plurality of raised ribs on the innermost curved surface of said clip.

15. The guide assembly as defined in claim 11, wherein a back surface of said clip that partially engages said front surface of said back plate is substantially straight sided with curvilinear portions at the top of the arc and at the outermost ends.

16. A billboard guide and tensioning system, comprising:

a billboard surface adapted to receive a facing area, said facing area surrounded by trim pieces, said trim pieces extend substantially around a perimeter of said billboard;

a first guide group located at an upper portion of said back plate and a second guide group located at a lower portion of said back plate, said guide groups each comprising an arced guide comprising two portions, a first portion angled with respect to said front surface of said back plate, and a second portion angled with respect to said first tab portion, said arced guide spans a degree of arc of approximately 180 degrees;

said guide group also comprising a clip that has a complimentary shape to said guide and selectively contacts said arced guide, said clip is substantially S-shaped, said S-shape comprising a dual channel sharing a single walled surface, said clip comprising two hook-like structures integrally formed with a bottom surface of said clip that contacts said front surface of said back plate, said hook-like structures selectively engage with end edge portions of said arced guide;

a cable member extends through said tab guides and contacts said second channel of said clip.

17. The billboard guide and tensioning system as defined in claim 16, wherein said arced guide is located between two tab guides formed from said back plate, said arced guide and said tab guides are separated by a section of said back plate.

18. The billboard guide and tensioning system as defined in claim 16, wherein a radiused transition is provided between said two tab portions of said arced guide.

19. The billboard guide and tensioning system as defined in claim 16, wherein said clip has a complimentary shape to said arced guide.

20. The billboard guide and tensioning system as defined in claim 16, wherein said clip contains an arched cut-out portion, said cut-out portion is perpendicular to said clip channels.

21. The billboard guide and tensioning system as defined in claim 16, wherein a keeper tab is centered over said arced guide.

22. The billboard guide and tensioning system as defined in claim 21, wherein said keeper tab comprises a first land portion, a first ramp portion, a second land portion located on a different vertical plan than the first land portion, a second ramp portion and a third land portion located within the same vertical plane as the first land portion.

23. The billboard guide and tensioning system as defined in claim 21, wherein said keeper tab further comprises apertures in each of said first land portion and said third land portion.

* * * * *